US006452334B1

(12) United States Patent
Ohshima et al.

(10) Patent No.: US 6,452,334 B1
(45) Date of Patent: Sep. 17, 2002

(54) ARC TUBE WITH RESIDUAL-COMPRESSIVE-STRESS LAYER FOR DISCHARGE LAMP UNIT AND METHOD OF MANUFACTURING SAME

(75) Inventors: Yoshitaka Ohshima; Nobuo Ohkawai; Shinichi Irisawa, all of Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 115 days.

(21) Appl. No.: 09/603,540

(22) Filed: Jun. 26, 2000

(30) Foreign Application Priority Data

Jun. 28, 1999 (JP) ..... 11-182025

(51) Int. Cl.[7] ..... H01J 61/04
(52) U.S. Cl. ..... 313/623; 313/332; 313/631
(58) Field of Search ..... 313/638, 631, 313/332, 574, 623, 25

(56) References Cited

U.S. PATENT DOCUMENTS

| | | | | |
|---|---|---|---|---|
| 3,956,660 A | * | 5/1976 | Ooms | 313/332 X |
| 5,286,227 A | | 2/1994 | Numajiri et al. | 445/26 |
| 5,387,839 A | * | 2/1995 | Giordano et al. | 313/332 X |
| 5,936,349 A | | 8/1999 | Fukai et al. | 313/623 |
| 5,936,350 A | * | 8/1999 | Yoshida et al. | 313/332 X |

FOREIGN PATENT DOCUMENTS

| | | | |
|---|---|---|---|
| EP | 0 887 838 A2 | 12/1998 | H01J/61/36 |
| GB | 2 338 823 A | 12/1999 | H01J/61/36 |
| JP | 55-27803 | 2/1980 | C03B/20/00 |

* cited by examiner

*Primary Examiner*—Ashok Patel
(74) *Attorney, Agent, or Firm*—Sughrue Mion, PLLC

(57) ABSTRACT

An arc tube provided with a central sealed chamber 12, in which light-emitting substances are enclosed, having a pair of electrode assemblies disposed opposite to each other. The electrode assemblies are sealed in pinch seal portions 13. The arc tube incorporates a residual-compressive-stress layer 16 formed on a surface of the glass layer 15 in each of the pinch seal portions 13 that contacts the electrode rod 6 included in each electrode assembly. The residual-compressive-stress layer has a length greater than or equal to 30% of the axial length of a glass layer region that only contacts the electrode rod 6 and/or an angular range greater than or equal to 180° in a circumferential direction of the electrode rod. Thermal stress (tensile stress) produced in the boundary between the glass layer 15 and the electrode rods 6 after the arc tube 10 has been turned on is absorbed and dispersed by the residual-compressive-stress layer 16 surrounding the electrode rods 6. Thus, any vertical crack that would result in the light-emitting substances leaking from the sealed chamber does not form in the glass layer 15 of the pinch seal portions 13.

15 Claims, 3 Drawing Sheets

W
W1
W2
W3
A
A'
P
Xe
LN2
22
24
24a
24b
26a
26b
26c
40
42
44
50
52
54
6
7
8
8b

ARC TUBE WITH RESIDUAL-COMPRESSIVE-STRESS LAYER FOR DISCHARGE LAMP UNIT AND METHOD OF MANUFACTURING SAME

BACKGROUND OF THE INVENTION

1. Technical Field of the Invention

The present invention relates to an arc tube for a discharge lamp unit structured such that two electrode assemblies are disposed opposite to each other in a central sealed chamber in which light emitting substances are enclosed. Each electrode assembly includes an electrode rod, molybdenum foil and a lead wire, and is sealed in a pinch seal portion adjacent to the central sealed chamber. Each pinch seal portion includes a residual-compressive-stress layer. The present invention also relates to a method for manufacturing an arc tube with a residual-compressive-stress layer.

2. Prior Art

FIG. 6 shows a conventional discharge lamp unit that incorporates an arc tube 5 having a front end supported by one lead support 2 projecting forward from an insulating base 1. A recess 1*a* of the base 1 supports the rear end of the arc tube 5. A metal support member S, secured to the front surface of the insulating base 1 holds a portion of the arc tube adjacent to the rear end of the arc tube. A front lead wire 8, extending from the arc tube 5, is welded to the lead support 2, while a rear lead wire 8 penetrates a bottom wall 1*b* having the recess 1*a* of the base 1 formed therein. Then, the rear lead wire 8 is, by welding, secured to a terminal 3 provided for the bottom wall 1*b*. Symbol G represents an ultraviolet-ray shielding globe arranged to remove an ultraviolet-ray component in the wavelength region harmful to the human body. The ultraviolet-ray shielding globe forms a cylindrical shape and is integrally welded to the arc tube 5.

The arc tube 5 has a sealed chamber portion 5*a* formed between a pair of front and rear pinch seal portions 5*b*. The sealed chamber portion 5*a* has electrode rods 6 disposed opposite to each other and contains light emitting substances. In the pinch seal portions 5*b*, the sealed molybdenum foil 7 connects the electrode rod 6 projecting into the sealed chamber portion 5*a* to the lead wire 8 extending from the pinch seal portion 5*b*. Thus, the pinch seal portions 5*b* remain airtight.

Preferably, the electrode rod 6 is made of tungsten exhibiting excellent durability. Tungsten has a coefficient of linear expansion that is considerably different from that of the quartz glass that constitutes the arc tube. Worse, only unsatisfactory conformability with quartz glass is permitted and the permitted airtightness is unsatisfactory. Therefore, the molybdenum foil 7 having a coefficient of linear expansion similar to that of quartz glass and exhibiting relatively satisfactory conformability is connected to the tungsten electrode rods 6. Moreover, the pinch seal portion 5*b* seals the molybdenum foil 7. Thus, pinch seal portions 5*b* remain airtight.

Referring to FIG. 7(*a*), a method of manufacturing the arc tube 5 is illustrated. An electrode assembly A comprises an electrode rod 6, molybdenum foil 7 and a lead wire 8. The components are integrally connected. The electrode assembly A is initially inserted into an end of either opening of a cylindrical glass tube W having a spherical expanded portion $w_2$ disposed at an intermediate position of a straight extending portion $w_1$. Then, adjacent position $q_1$ of the spherical expanded portion $w_2$ undergoes a primary pinch-seal operation.

Referring to FIG. 7(*b*), a light emitting substance P and the like are introduced into a spherical expanded portion $w_2$ through the other end opening of cylindrical glass tube W. Referring to FIG. 7(*c*), a second electrode assembly A is inserted. A secondary pinch sealing operation seals the spherical expanded portion $w_2$, while simultaneously cooling the spherical expanded portion $w_2$ by using liquid nitrogen to prevent both vaporization of the light emitting substance P and heating the adjacent position $q_2$ of the spherical expanded portion $w_2$. The final result is an arc tube 5 having the chipless sealed chamber portion 5*a*.

Referring to FIG. 7(*b*), the primary pinch-sealing operation uses inactive gas (in general, which is low-cost argon gas or nitrogen gas) as forming gas into the glass tube W in order to prevent oxidation of the electrode assembly A. Referring to FIG. 7(*c*), in the secondary pinch-sealing operation, the ends of the openings in cylindrical glass tube W are closed and cooling with liquid nitrogen prevents vaporization of the light emitting substance P. Therefore, a state of near vacuum is necessary for the pinch-sealing operation.

Since a large temperature change occurs between a state where the arc tube is turned on and a state where the arc tube is turned off, thermal stress occurs between the electrode rod and the glass layer. The electrode rod and the glass layer each have considerably different coefficients of linear expansion when the arc tube is turned on. In recent years, the arc tube structure now lights instantaneously. Therefore, a high temperature-rise ratio is realized. After repeated cycling, a crack forms in the pinch seal portion (the glass layer) for sealing the electrode rods 6. Thus, the sealed substances leak, thereby causing a defect in the lighting of the arc tube and shortening its life.

In view of the foregoing, the inventor has repeatedly performed experiments and studies to solve the foregoing problems experienced with the conventional technique. As a result, the inventor discovered that retention of compressive stress produced in the pinch seal portions 5*b* during the arc tube manufacturing process causes a thermal stress in the glass layer in the pinch seal portion to disperse due to rise in the temperature occurring after turning the arc tube on. Therefore, prevention of the formation of a crack in the glass layer in the pinch seal portion will extend the life of the arc tube.

BRIEF SUMMARY OF THE INVENTION

The present invention solves the problems experienced with the conventional technique and in accordance with the inventor's discovery. An object of the invention is to provide an arc tube for a discharge lamp unit that is free of crack formation in the pinch seal portion when the thermal stress changes due to arc tube cycling.

To achieve the object, an arc tube for a discharge lamp unit comprising at least two electrode assemblies, each of the electrode assemblies comprising an electrode rod, a foil and a lead wire integrally connected in series, a tube having a central sealed chamber enclosing light emitting substances, and further comprising pinch seal portions disposed at opposite ends of the chamber, each pinch seal portion enclosing an electrode assembly such that the electrode rod projects into the chamber and the lead wire projects from the pinch seal portion, and a residual-compressive-stress layer facing a glass layer region in each of the pinch seal portions, the residual-compressive-stress layer hermetically contacting the electrode rod, wherein the residual-compressive-stress layer and the glass layer region extending only along the electrode rod.

According to another aspect of the invention, the residual-compressive-stress layer is formed for a length greater than or equal to 30% of the axial length of the glass layer region that only contacts the electrode rod.

According to another aspect of the invention, the residual-compressive-stress layer is formed in an angular range of about 180° or larger in the circumferential direction of the electrode rod.

According to another aspect of the invention, the residual-compressive-stress layer is formed for a length greater than or equal to 30% of the axial length of the glass layer region that only contacts the electrode rod and in an angular range of about 180° or larger in the circumferential direction of the electrode rod.

No thermal stress is produced in the boundary between the glass layer and the electrode rod immediately after the pinch-sealing operation. When the temperature returns to room temperature, the boundary between the electrode rod (made of tungsten) and the glass (quartz glass) encounters generation of thermal stress (tensile stress in the electrode rod and compressive stress in the glass layer). The thermal stress corresponds to the difference between the coefficient of linear expansion of the electrode rod and that of the quartz glass. Therefore, a state in which great stress (the tensile stress in the electrode rod and the compressive stress in the glass layer) is produced is maintained.

After lamp turn on, the arc tube temperature does not rise to a level at which the pinch seal portion is pinch-sealed. Therefore, when the residual-compressive-stress layer on the glass layer has been formed over a wide range, the thermal stress produced in the glass layer of the arc tube after lamp turn-on causes the compressive stress left in the glass layer of the pinch seal portion to be reduced in both of the axial direction and the circumferential direction.

That is, the thermal stress (tensile thermal stress) for relaxing the residual compressive stress acts on the glass layer in the pinch seal portion when the lamp is turned on. When the residual-compressive-stress layer is too small, the thermal stress is concentrated to the small residual-compressive-stress layer. When the lamp is repeatedly turned on and off, the thermal stress is repeatedly acts upon the glass layer. Thus, there is a possibility that a crack allowing the sealed light emitting substances to leak can form. Specifically, when the axial length of the residual-compressive-stress layer is shorter than 30% of the axial length of the glass layer region which hermetically contacts only the electrode rod, the thermal stress in the axial direction cannot sufficiently be absorbed. In the foregoing case, concentration of the stress to the residual-compressive-stress layer causes the sealed light emitting substances to leak through the glass layer. When the angular range of the residual-compressive-stress layer in the circumferential direction of the electrode rod is smaller than about 180°, the thermal stress in the circumferential direction cannot sufficiently be absorbed. Thus, the stress is concentrated to the residual-compressive-stress layer and, therefore, a vertical crack of the glass layer forms that allows the sealed light emitting substances to leak.

The compressive stress layer is previously formed in a predetermined wide region in the axial direction or/and the circumferential direction on the surface of hermetic contact between the glass layer and the electrode rod. Therefore, the compressive stress layer (the residual compressive stress layer) formed in the large range efficiently relaxes (absorbs) the thermal stress produced in the glass layer as the temperature is raised.

Namely, the residual-compressive-stress layer present over a predetermined large range disperses the thermal stress that is repeatedly produced before the thermal stress is transmitted to the glass layer. Therefore, the glass layer does not crack and none of the sealed substances leak.

According to another aspect of the invention, the residual-compressive-stress layer has a boundary crack formed in the outer surface of the residual-compressive-stress layer.

The thermal stress acting on the boundary between the electrode rod and the glass layer after the lamp has been turned on is absorbed because the glass layer slides along the boundary crack.

According to another aspect of the invention, the pinch seal portion in which the electrode rod is sealed is pinch-sealed in a temperature range from 2000° C. to 2300° C., preferably in a temperature range of 2100° C. to 2200° C.

Quartz glass has a softening point of 1600° C. Moreover, the permissible machining temperature is 1800° C. Therefore, when the temperature of the glass tube (a portion which must be pinch-sealed) is 2000° C. or lower, the temperature in the glass layer (a portion including the electrode rod) is not raised to a level which is sufficiently high to maintain the adhesion with the electrode rod. Preferably, to form the residual-compressive-stress layer in a large area in the axial direction and the circumferential direction of the electrode rod, the pinch seal portion (in which the electrode rod is sealed) is pinch-sealed at a temperature of 2000° C. or higher, more preferably 2100° C. or higher.

When the temperature of the glass tube (the portion which must be pinch-sealed is 2300° C. or higher, no effect to enlarge the residual-compressive-stress layer can be obtained. Moreover, the pincher for pinch-sealing the glass tube and the arc-tube support member must exhibit severe heat resistance during the pinch-sealing operation. Preferably, to efficiently form the residual-compressive-stress layer, the pinch seal portion (in which the electrode rod is sealed) is pinch-sealed at a temperature of 2300° C. or lower, preferably 2200° C. or lower.

BRIEF DESCRIPTION OF THE DRAWINGS

FIG. 5(*b*) is a diagram showing a second pinch-sealing step in the primary pinch-sealing operation;

FIG. 5(*c*) is a diagram showing a step for introducing light emitting substances and a second electrode assembly;

FIG. 5(*d*) is a diagram showing a chip-off step;

FIG. 5(*e*) is a diagram showing a pinch-sealing step in the secondary pinch-sealing operation;

DETAILED DESCRIPTION OF THE INVENTION

Figure 1:
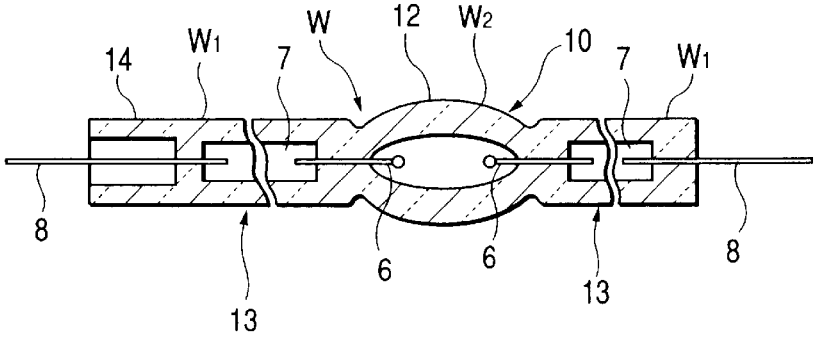
FIG. 1 is a vertical cross sectional view showing an arc tube for a discharge lamp unit according to an embodiment of the present invention.

Referring now to the drawings, a preferred embodiment will be described.

Figure 2:
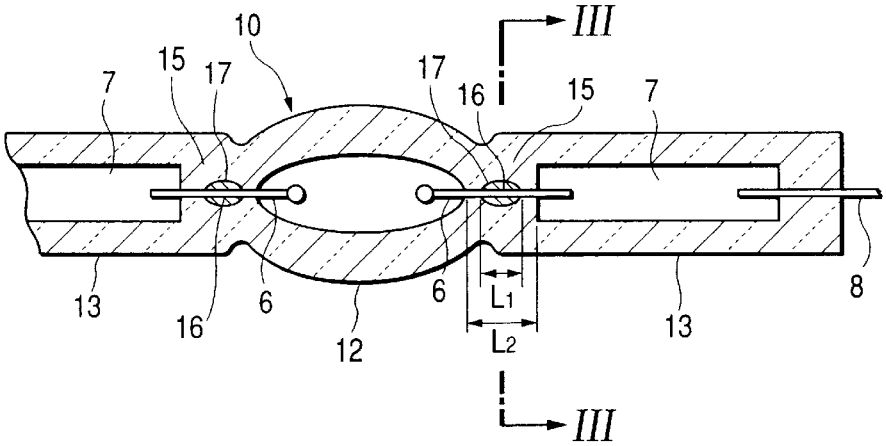
FIG. 2 is an enlarged cross sectional view showing an essential portion of a pinch seal portion of the arc tube.

FIGS. 1 to 5 show an embodiment of the present invention. FIG. 1 is a vertical cross sectional view showing an arc tube for a discharge lamp unit according to the embodiment of the invention. FIG. 2 is an enlarged cross sectional view showing an essential portion of a pinch seal portion of the arc tube.

Figure 3:
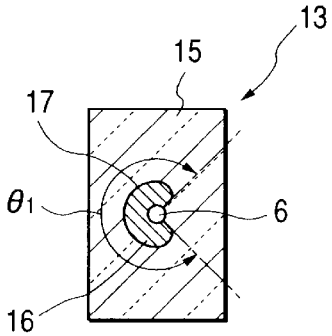
FIG. 3 is a lateral cross sectional view (a cross sectional view taken along line III—III shown in FIG. 2) of the pinch seal portion.
Figure 4:
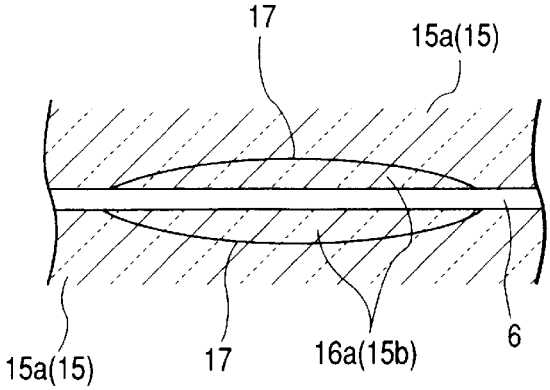
FIG. 4 is a diagram showing a phenomenon that a glass layer slides along a boundary crack formed in the compressive stress layer.
Figures 5A, 5B, 5C, 5D, 5E:
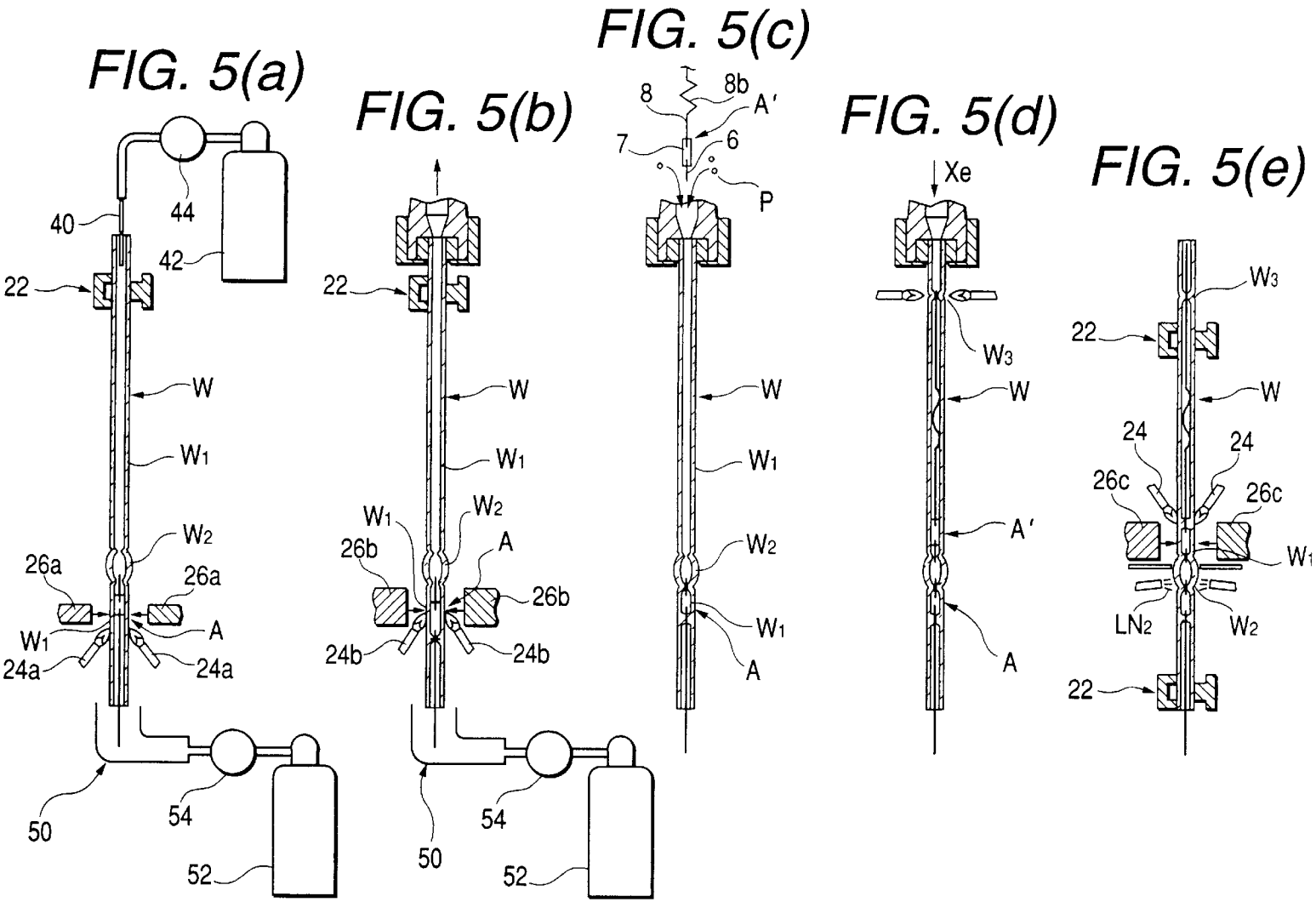
FIG. 5(*a*) is a diagram showing a first pinch-sealing step in the primary pinch-sealing operation.

FIG. 3 is a lateral cross sectional view (a cross sectional view taken along line III—III shown in FIG. 2) of the pinch seal portion. FIG. 4 is a diagram showing a phenomenon that the glass layer slides along a boundary crack formed in the compressive stress layer. FIG. 5 is a diagram showing steps for manufacturing the arc tube according to the disclosed embodiment.

Figure 6:
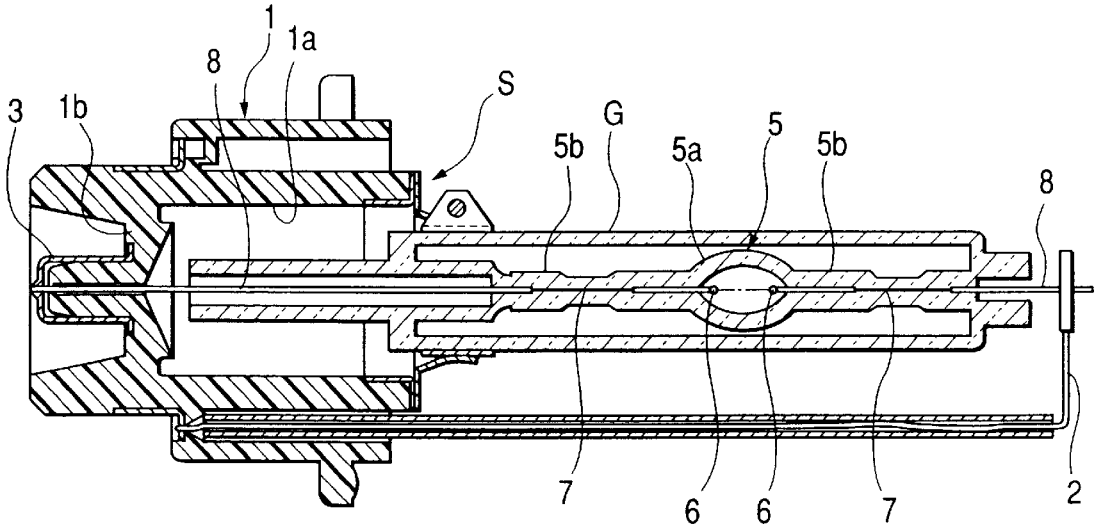
FIG. 6 is a cross sectional view showing a conventional discharge lamp.
Figures 7A, 7B, 7C:
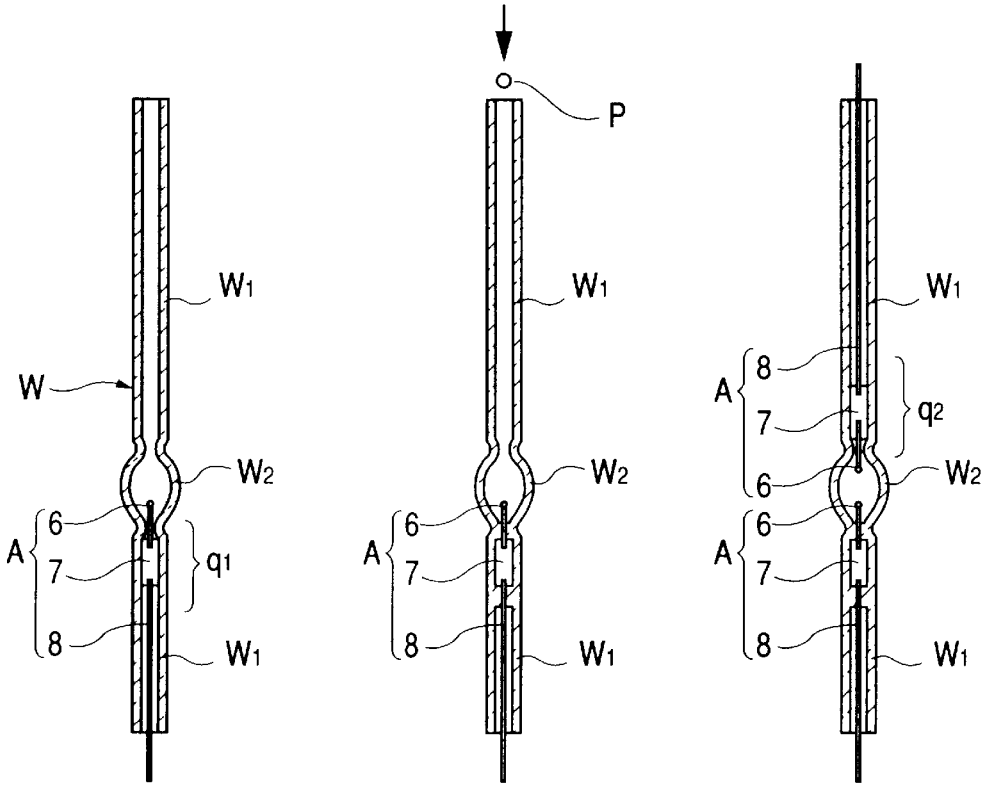
FIG. 7 is a diagram showing a process for manufacturing a conventional arc tube.

Referring to FIG. 6, the discharge lamp unit on which an arc tube 10 is mounted has the same structure as the conventional structure. Therefore, the description of the discharge lamp unit is omitted.

Referring to FIGS. 1 and 2, the arc tube 10 comprises a quartz glass tube W having a spherical expanded portion $w_2$ formed at an intermediate position of a straight extending portion $w_1$ in a lengthwise direction. Portions adjacent to the spherical expanded portion $w_2$ of the quartz glass tube W are pinch-sealed. Thus, pinch seal portions 13, each having a rectangular cross sectional shape, are at the two ends of a chipless sealed chamber portion 12 constituting an elliptically-shaped discharge space. The sealed chamber portion 12 encloses a starting rare gas, mercury and a metal halide (hereinafter called "light emitting substances").

In the sealed chamber portion 12, tungsten electrode rods 6 constituting discharge electrodes are disposed opposite to each other. The electrode rods 6 connect to molybdenum foil 7 sealed in the pinch seal portions 13. Molybdenum lead wires 8 connected to the molybdenum foil 7 extend from ends of the pinch seal portions 13. The rear lead wire 8 penetrates a circular-pipe-shape portion 14 that is not pinch-sealed to extend to the outside.

Referring to FIG. 1, the shape of the arc tube 10 is similar to that of the conventional arc tube 5 shown in FIG. 6. To improve conformability with quartz glass, the outer surface of the tungsten electrode rod 6 has small pits and projections formed by strong electrolytic polishing. Moreover, the region of the glass layer of the pinch seal portions 13 hermetically contacts the electrode rods 6 and has a residual-compressive-stress layer 16 that exhibits high adhesion with the electrode rods 6 and has a predetermined size.

Referring to FIGS. 2 and 3, the residual-compressive-stress layer 16 extends along the electrode rods 6 to surround the electrode rods 6. Length $L_1$ of the residual-compressive-stress layer 16 in the axial direction of the residual-compressive-stress layer 16 is not shorter than about 30% of axial-directional length $L_2$ of the glass layer which is hermetic contact with only the electrode rods 6. The residual-compressive-stress layer 16 forms an angular range $\theta_1$ that is 180° or larger in the circumferential direction of the electrode rods 6.

The pinch-sealing operation does not immediately produce any thermal stress in the boundary between the glass layer 15 and the electrode rods 6. When the temperature has been restored to the room temperature, thermal stress (tensile stress in the electrode rod and compressive stress in the glass layer) corresponding to the difference ($45\times10^{-7}$ 1/° C. and $5\times10^{-7}$ 1/° C.) in the coefficient of linear expansion between the two elements acts on the boundary between the element rod (tungsten) 6 and glass (quartz glass). Therefore, the electrode rods 6 exhibit residual tensile stress and the glass layer exhibits residual compressive stress.

The residual-compressive-stress layer 16 forms in the wider range of the glass layer. Moreover, the temperature of the arc tube 10 (the pinch seal portions 13) realized after the lamp has been turned on is not raised to the level used to pinch-seal the pinch seal portions 13. Therefore, turning the lamp on produces thermal stress in the glass layer 15 of the pinch seal portions 13 that reduces the compressive stress left in the glass layer 15 of the pinch seal portions 13.

That is, the thermal stress (tensile thermal stress), in a direction that relaxes the residual compressive stress, acts on the glass layer 15 in the pinch seal portion after the lamp has been turned on. When the area of the residual-compressive-stress layer 16 in the axial and circumferential directions of the electrode rods 6 is small, thermal stress is concentrated to the residual-compressive-stress layer 16. When the lamp is exercised repeatedly, thermal stress is exerted repeatedly. Thus, the possibility exists that a vertical crack that allows the sealed substances to leak may form in the glass layer 15.

The surface of hermetic contact between the glass layer 15 and the electrode rods 6 has the residual-compressive-stress layer 16 that exhibits excellent adhesion. The residual-compressive-stress layer 16 forms in a wide range for $L_1 \geqq 0.3\ L_2$ in the axial direction of the electrode rods 6 and $\theta_1 \geqq 180°$ in the circumferential direction of the electrode rods 6. The compressive stress layer (the residual-compressive-stress layer) 16 efficiently relaxes the thermal stress produced in the glass layer 15 as the temperature is raised.

Namely, the residual-compressive-stress layer 16 disperses the thermal stress resulting from lamp turn-on before it is transmitted to the glass layer 15. Therefore, a vertical crack that allows the sealed substances to leak does not occur in the glass layer 15.

Referring to FIG. 3, the residual-compressive-stress layer 16 has a visible boundary crack 17 that surrounds the electrode rods 6 and extends to form a circular arc shape (a cylindrical shape). Thus, the boundary crack 17 absorbs the thermal stress between the electrode rods 6 and the glass layer 15 because the glass layers 15*a* and 15*b* slide along the boundary crack 17.

That is, after lamp turn-on, thermal stress occurs between the glass layer 15 and the electrode rods 6 in the pinch seal portions 13. Referring to FIG. 4, the glass layer 15*b* that hermetically contacts the electrode rods 6 on the inside of the boundary crack 17 slides with respect to the glass layer 15*a* on the outside of the boundary crack 17. Thus, the boundary crack 17 absorbs the thermal stress that acts on the boundary between the electrode rods 6 and the glass layer 15. Therefore, the vertical crack that causes the sealed substances to leak does not form in the glass layer 15.

The residual-compressive-stress layer 16 is formed for the length $L_1 \geqq 0.3\ L_2$ in the axial direction and $\theta_1 \geqq 180°$ in the glass layer 15 of the pinch seal portions 13. To form the residual-compressive-stress layer 16 as described above, it is preferable that the tube manufacturing process pinch-seals the portions that must be pinch-sealed at a temperature range from 2000° C. to 2300° C., preferably in a temperature range from 2100° C. to 2200° C.

The inventor performed an EU switching-mode acceleration test. Consequently, the mean life of the arc tube incorporating the residual-compressive-stress layer 16 with a length $L_1 \geqq 0.3\ L_2$ in the axial direction and $\theta_1 \geqq 180°$ was 1156 hours. On the other hand, the life of an arc tube (comparative example) incorporating the residual-compressive-stress layer 16 formed for $L_1 < 0.3\ L_2$ and $\theta_1 < 180°$ was 483 hours.

That is, the EU switching-mode acceleration test resulted in the arc tube according to this embodiment having a useful life nearly three times longer than the life of the conventional arc tube. Therefore, when used in a usual manner, an arc tube of the present invention has a considerably longer life as compared to that of the conventional arc tube.

Referring to FIG. 5, a process for manufacturing the arc tube having the chipless sealed chamber portion 12 shown in FIG. 1 will now be described.

The glass tube W having a spherical expanded portion $w_2$ formed at an intermediate position of a straight extending portion $w_1$ is manufactured. Then, referring to FIG. 5(*a*), glass-tube holding member 22 positions the glass tube W vertically. Then, the electrode assembly A is inserted into an end of the downward opening of the glass tube W so as to be supported at a predetermined position. Then, an inactive gas (argon gas or nitrogen gas) supply nozzle 40 is inserted into the end of the upper opening of the glass tube W. Then, the lower end of the glass tube W is inserted into an inactive gas (argon gas or nitrogen gas) supply pipe 50.

The inactive gas supplied through the nozzle 40 prevents oxidation of the electrode assembly A during the pinch-sealing process. The inactive gas supplied through the gas supply pipe 50 maintains an inactive gas atmosphere around the lead wire 8 to prevent oxidation of the lead wire 8 during the pinch-sealing process and after the pinch-sealing process. Referring to FIG. 5(*a*), gas cylinders 42, 52 supply the inactive gas. Gas-pressure regulators 44, 54 regulate the inactive-gas flow.

Referring to FIG. 5(*a*), while supplying inactive gas into the glass tube W through both the nozzle 40 and the pipe 50, burner 24*a* heats the position (the position including the molybdenum foil) adjacent to the spherical expanded portion $w_2$ in the straight extending portion $w_1$ to 2100° C. Moreover, the pincher 26*a* pinch-seals a portion of the primary pinch seal portion, which includes the portion of the molybdenum foil 7 connected to the lead wire 8, for the temporary purpose.

Referring to FIG. 5(*b*), after completion of the temporary pinch-sealing process, a vacuum pump (not shown) maintains a vacuum (a pressure level not higher than 400 Torr) in the glass tube W. Then, a burner 24*b* raises the temperature to 2100° C. The pincher 26*b* pinch-seals another portion of the primary pinch-seal portion that includes the molybdenum foil 7. Preferably, the vacuum exerted on the inside portion of the glass tube W is 400 Torr to $4 \times 10^{-3}$ Torr.

Thus, within the primary pinch seal portion 13, the glass layer 15 hermetically contacts the electrode rod 6, the molybdenum foil 7 and the lead wire 8 constituting the electrode assembly A. In particular, the glass layer 15 hermetically contacts the electrode rod 6 and the molybdenum foil 7 such that satisfactory conformability is realized and the glass layer 15 and the molybdenum foil 7 are firmly joined to each other. After the primary pinch seal portion has been cooled, the residual-compressive-stress layer 16 having the predetermined size is formed. The boundary crack 17 forms in the residual-compressive-stress layer 16. In addition, in the primary pinch-sealing process, the atmosphere of the lower opening of the glass tube W is made to be the inactive gas (argon gas or nitrogen gas). This prevents the oxidation of the lead wire 8.

Referring to FIG. 5(*c*), the light emitting substances P are introduced into the spherical expanded portion $w_2$ through an end of the upward opening of the glass tube W. Then, a second electrode assembly A', comprising an electrode rod 6, molybdenum foil 7 and lead wire 8, is inserted to a predetermined position.

The lead wire 8 has a bent portion 8*b* formed at an intermediate position in the lengthwise direction, wherein the bent portion 8*b* is formed into a W-shape. The bent portion 8*b* presses against an inner surface of the glass tube W so that the electrode assembly A' remains at a predetermined position in the lengthwise direction of the straight extending portion $w_1$.

The inside portion of the glass tube W is exhausted, and then, as shown in FIG. 5(*d*), a predetermined upper portion of the glass tube W is chipped off while supplying xenon gas into the glass tube W. Thus, the electrode assembly A' having the lead wire is temporally joined to the inside portion of the glass tube W. Moreover, the light emitting substances are enclosed. Note that symbol $w_3$ represents a chip-off portion.

Referring to FIG. 5(*e*), cooling the spherical expanded portion $w_2$ with liquid nitrogen ($LN_2$) prevents vaporization of the light emitting substances P. Burner 24 heats the position (the position including the molybdenum foil) adjacent to the spherical expanded portion $w_2$ of the straight extending portion $w_1$ to 2100° C. Then, the pincher 26*c* performs a secondary pinch-sealing operation to seal the spherical expanded portion $w_2$. Thus, the arc tube incorporates the chipless sealed chamber portion 12 wherein the electrode rods 6 are disposed opposite to each other and the light emitting substances P are enclosed.

The pinch-sealing operation to seal the spherical expanded portion $w_2$ does not require that the inside portion of the glass tube W to be at a negative pressure (by operating the vacuum pump). In this case, xenon gas enclosed in the glass tube W is liquefied so that the inside portion of the glass tube W is made to be negative pressure (about 400 Torr). Therefore, the adhesion of the glass layer to the electrode assembly A' (the electrode rod 6, the molybdenum foil 7 and the lead wire 8) in the secondary pinch seal portion 13B improves.

Similarly to the pinch-sealing operation for the primary pinch-seal portion, the negative pressure acts on the glass layer softened due to supplied heat as well as the pressure exerted by the pincher 26*c*. Therefore, the glass layer hermetically contacts the electrode rod 6, the molybdenum foil 7 and the lead wire 8 without any gap and with satisfactory conformability. Consequently, the glass layer and the electrode rod 6, the molybdenum foil 7 and the lead wire 8 are firmly joined to each other. After the secondary pinch seal portion 13 has cooled, the residual-compressive-stress layer 16 and the boundary crack 17 similar to those formed in the primary pinch seal portion 13 form. Finally, the end of the glass tube is cut to a predetermined length so that the arc tube 10 shown in FIG. 1 is obtained. A stress gauge (not shown) measures the size of the residual-compressive-stress layer 16 provided in the pinch seal portion of the manufactured arc tube. When the residual-compressive-stress layer 16 is larger than a predetermined size, the sample is allowable. When the size is smaller than a predetermined size, the sample is not allowed.

In the foregoing embodiment, the residual-compressive-stress layer 16 having a predetermined size forms on the surface of the glass layer 15 in the pinch seal portions 13 at each of the front and rear ends which is hermetically contacting the electrode rods 6. Moreover, the boundary crack 17 forms in the residual-compressive-stress layer 16.

Another structure may be employed in which the boundary crack 17 is not formed in the residual-compressive-stress layer 16.

In the foregoing embodiment, the residual-compressive-stress layer 16 formed on the surface of the glass layer 15 in the pinch seal portions 13 at each of the front and rear ends which hermetically contacts the electrode rods 6. The residual-compressive-stress layer 16 has the predetermined length $L_1$ in the axial direction and the predetermined angle $\theta_1$ in the circumferential direction. A structure having the predetermined length $L_1$ in only the axial direction or a structure having the predetermined angle $\theta_1$ in only the circumferential direction may be employed.

In the foregoing embodiment, the glass tube W having a spherical expanded portion $w_2$ undergoes a primary pinch-sealing operation so that the sealed chamber portion 12 in which the electrode rods 6 are disposed opposite to each other is sealed. Thus, the arc tube having the chipless sealed chamber portion 12 is manufactured. The present invention is applied to the manufactured chipless arc tube.

The present invention may be applied to an arc tube having a chip portion. That is, two ends of a glass tube having a spherical expanded portion to which an exhaust pipe is continuously connected are pinch-sealed. Thus, a spherical expanded portion (in the chamber portion) in which the electrodes are disposed opposite to each other is formed. Then, the light emitting substances and the like are supplied into the spherical expanded portion (in the chamber portion) through the exhaust pipe. Then, the exhaust pipe is chipped off so that the chamber portion is sealed. Thus, the arc tube having a chip can be manufactured. Also the present invention may be applied to the arc tube having the chamber provided with the chip portion.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated.

What is claimed is:

1. An arc tube for a discharge lamp unit comprising:

at least two electrode assemblies, each of said electrode assemblies comprising an electrode rod, a foil and a lead wire integrally connected in series;

a tube having a central sealed chamber enclosing light emitting substances, and further comprising pinch seal portions disposed at opposite ends of said chamber, each pinch seal portion enclosing an electrode assembly such that the electrode rod projects into said chamber and the lead wire projects from the pinch seal portion; and a residual-compressive-stress layer facing a glass layer region in each of said pinch seal portions, said residual-compressive-stress layer hermetically contacting the electrode rod, wherein said residual-compressive-stress layer and said glass layer region extending only along said electrode rod.

2. The arc tube for a discharge lamp unit according to claim 1, wherein said residual-compressive-stress layer has a boundary crack in an outer surface of said residual-compressive-stress layer.

3. The arc tube for a discharge lamp unit according to claim 1, wherein said residual-compressive-stress layer has a length greater than or equal to 30% of the axial length of said glass layer region which is in contact only with said electrode rod.

4. The arc tube for a discharge lamp unit according to claim 1, wherein said residual-compressive-stress layer is in an angular range of about 180° or larger in the circumferential direction of said electrode rod.

5. The arc tube for a discharge lamp unit according to claim 1, wherein said residual-compressive-stress layer has a length greater than or equal to 30% of the axial length of said glass layer region which is in contact only with said electrode rod and in an angular range of about 180° or larger in the circumferential direction of said electrode rod.

6. The arc tube for a discharge lamp unit according to claim 1, wherein said tube comprises quartz glass.

7. The arc tube for a discharge lamp unit according to claim 1, wherein the electrode rod of each of said electrode assemblies comprises tungsten.

8. The arc tube for a discharge lamp unit according to claim 7, wherein the lead wire of one of said electrode assemblies includes a bent portion that presses against an inner surface of said tube.

9. The arc tube for a discharge lamp unit according to claim 1, wherein the foil of each of said electrode assemblies comprises molybdenum.

10. The arc tube for a discharge lamp unit according to claim 1, wherein said chamber has an elliptical shape.

11. The arc tube for a discharge lamp unit according to claim 1, wherein said light emitting substances enclosed within said chamber include a starting rare gas, mercury and a metal halide.

12. The arc tube for a discharge lamp unit according to any one of claims 1–5, wherein said each pinch seal portion is formed by heating the glass tube to a temperature of at least 2000° C. prior to pinch-sealing.

13. The arc tube for a discharge lamp unit according to any one of claims 1–5, wherein said each pinch seal portion is formed by heating the glass tube to a temperature no greater than 2300° C. prior to pinch-sealing.

14. The arc tube for a discharge lamp unit according to any one of claims 1–5, wherein said each pinch seal portion is formed by heating the glass tube to a temperature range of 2100° C. to 2200° C. prior to pinch-sealing.

15. The arc tube for a discharge lamp unit according to any one of claims 1–5, wherein said each pinch seal portion is formed by heating the glass tube to a temperature range of 2000° C. to 2300° C. prior to pinch-sealing.

* * * * *